US006926083B2

(12) United States Patent
Larovere

(10) Patent No.: US 6,926,083 B2
(45) Date of Patent: Aug. 9, 2005

(54) CEMENT HEATING TOOL FOR OIL AND GAS WELL COMPLETION

(75) Inventor: Thomas A Larovere, Santa Barbara, CA (US)

(73) Assignee: Homer L. Spencer, Calgary (CA)

( * ) Notice: Subject to any disclaimer, the term of this patent is extended or adjusted under 35 U.S.C. 154(b) by 0 days.

(21) Appl. No.: 10/308,867

(22) Filed: Dec. 2, 2002

(65) Prior Publication Data

US 2004/0104045 A1 Jun. 3, 2004

Related U.S. Application Data

(63) Continuation-in-part of application No. 10/289,917, filed on Nov. 6, 2002.

(51) Int. Cl.[7] ..... E21B 36/04
(52) U.S. Cl. ..... 166/302; 166/60; 166/61
(58) Field of Search ..... 166/57–61, 65.1, 166/288, 302; 219/643, 644

(56) References Cited

U.S. PATENT DOCUMENTS

| | | | | | |
|---|---|---|---|---|---|
| 2,281,334 | A | | 4/1942 | Somes | |
| 2,302,774 | A | | 11/1942 | Jarvis | |
| 3,097,282 | A | | 7/1963 | Cronberger | |
| 4,116,273 | A | * | 9/1978 | Fisher et al. | 166/248 |
| 5,167,280 | A | * | 12/1992 | Sanchez et al. | 166/267 |
| 6,353,706 | B1 | | 3/2002 | Bridges | |
| 6,474,414 | B1 | | 11/2002 | Gonzalez et al. | |

FOREIGN PATENT DOCUMENTS

| | | | | |
|---|---|---|---|---|
| JP | 62169612 A | * | 7/1987 | B29C/45/27 |
| WO | WO02/099247 | | 12/2002 | |

* cited by examiner

*Primary Examiner*—Zakiya Walker
(74) *Attorney, Agent, or Firm*—John Russell Uren

(57) ABSTRACT

Apparatus and method for setting cement in the annulus of an oil or gas well during well completion or other similar well operations. An induction heating tool is lowered to a desired position within the well casing and power is supplied to the tool to heat the casing and the cement which has been injected in the annulus adjacent the heated well casing and the wellbore.

2 Claims, 12 Drawing Sheets

CEMENT HEATING TOOL FOR OIL AND GAS WELL COMPLETION

CROSS-REFERENCE TO RELATED APPLICATION

This application is a continuation-in-part of application Ser. No. 10/289,917 filed Nov. 6, 2002 and entitled DOWNHOLE ELECTROMAGNETIC HEATING TOOL AND METHOD OF USING SAME (Larovere).

INTRODUCTION

This invention relates to the completion of oil and gas wells and, more particularly, to the completion of oil and gas wells by setting the casing cement with a heating tool, such tool conveniently being an inductive type heating tool.

BACKGROUND OF THE INVENTION

Completion procedures for oil and gas wells include lining the drilled hole with a steel casing. The casing is held in place by pumping cement formulations down the casing and upwards into the annular space between the outside surface of the casing and the wall of the wellbore. Typically, successive casing strings are run in progressively smaller diameters as the well is drilled. The number of casing strings used is determined by the drilling engineer to optimize completion costs based on, inter alia, well depth and the geological pressures that must be contained and controlled by the casing strings.

The casing cement between the well casing and the wellbore is designed to set within a certain time period based on the length of time that is required to pump the cement into its desired location and further to allow for anticipated equipment failures and the like. The cement is also designed for utilisation with the temperature and other physical factors associated with the intended location of the well cement.

Cement hardens or sets in a certain period depending on chemical reactions between the cement components. The temperature of the reacting materials is an important parameter and is used to determine the rate at which the reaction takes place. The temperature further is an important factor in determining the physical properties of the solidified cement.

In conducting the drilling and casing operations, a first relative large diameter hold is drilled to a predetermined depth. A steel casing of appropriate diameter is run from the surface to that initial depth. Cement is subsequently pumped down the casing. The cement is followed by a plug which pushes the cement into the well annulus outside the casing string from the bottom of the casing. The cement is then allowed to set. The period of time for the setting to take place is called "waiting for cement" (WOC). During this period the drill rig and the operating crew can do no further work on that well.

When the cement has set and the well passes a pressure test to ensure the cement will hold a specified pressure, the drilling continues. The plug and the residual cement is drilled through within the previously installed casing. When the depth of the next drilling stage is reached, a similar procedure follows and so on until the final desired well depth is reached. In particularly deep wells, there may be four (4) or more successive casing strings, each having an associated waiting period while the cement installed for that casing sets.

The WOC is expensive and disadvantageous. Wells are typically drilled under drilling agreements based on the time required to perform the drilling and casing operations. The deeper the well, the higher the costs which costs increase with the greater size and complexity of the drilling equipment necessary for the deep drilling. In particularly deep offshore wells, for example, the WOC can be twenty-four (24) hours or greater for each casing string. It would be clearly be desirable to reduce this time.

In our recently issued U.S. Pat. No. 6,384,389 (Spencer), the contents of which are incorporated herein by reference and in our co-pending application Ser. No. 10/289,917, not yet assigned, filed Nov. 6, 2002 and entitled DOWNHOLE INDUCTION HEATING TOOL AND METHOD OF USING SAME, the contents of which are also incorporated herein by reference, there is disclosed an induction heating tool that is contemplated to be useful and to overcome some of the aforementioned difficulties in setting cement.

SUMMARY OF THE INVENTION

According to one aspect of the invention, there is provided a tool for increasing the temperature of cement surrounding well casing in an oil or gas well, said tool being an inductive type tool applying a predetermined temperature to said casing and said cement, said temperature of said casing being monitored and controlled during said temperature increasing operation of said tool.

According to a further aspect of the invention, there is provided a method of operating a well tool of the induction type during the cementing operations while drilling an oil or gas well, said method comprising lowering said well tool from the surface where said drilling is taking place to a predetermined depth from said surface within said well and adjacent cement surrounding said casing at said predetermined depth, said well tool heating said cement surrounding said casing for a predetermined time period to a predetermined temperature, said time period and said temperature being monitored from said surface.

According to yet a further aspect of the invention, there is provided a method of melting electrically conductive material surrounding the casing of an oil or gas well with an electromagnetic induction tool comprising providing said electrically conductive material around the circumference of said tool and inducing electromagnetic induction from said tool into said material, raising the temperature of said material to a value sufficient to melt said material.

According to still yet a further aspect of the invention, there is provided apparatus for melting electrically conductive material in the annulus of an oil or gas well comprising an electromagnetic induction tool, a power supply to supply power to said tool and material operable to surround the circumference of said tool, said material being an electrically conductive material forming a closed loop surrounding said circumference.

BRIEF DESCRIPTION OF THE SEVERAL VIEWS OF THE DRAWINGS

Specific embodiments of the invention will now be described, by way of example only, with the use of drawings in which.

DESCRIPTION OF SPECIFIC EMBODIMENT

Figure 1A:
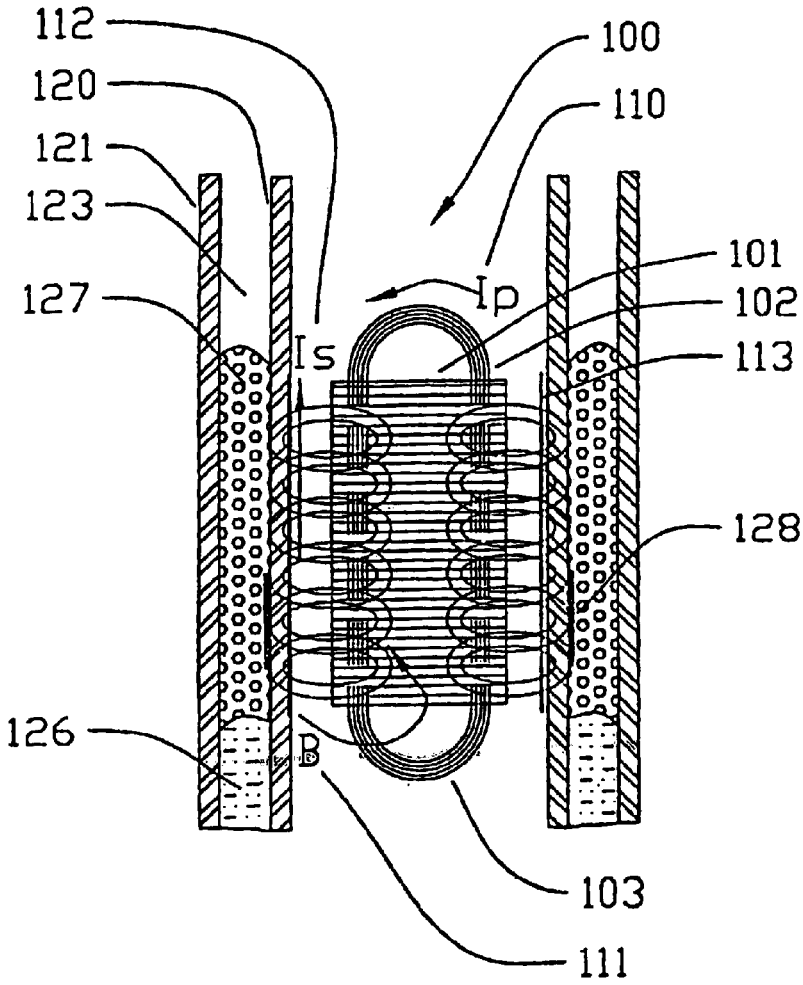
FIG. 1A PRIOR ART
FIG. 1A is a diagrammatic side view of an inductive heating tool used to generate heat in a well casing according to the PRIOR art.

Referring now to the drawings, there is provided a well inductive heating tool generally illustrated at 100 according to the PRIOR ART which tool is illustrated in FIG. 1. Such a tool is illustrated and described in our U.S. Pat. No. 6,384,389, the contents of which are disclosed herein by reference.

The well inductive heating tool 100 is used for downhole well heating as will be described further in association with FIG. 2. However, the tool 100 illustrated in FIGS. 1A and 1B comprises a laminated magnetically permeable core 101 with the core laminations running orthogonal to the axis of the tool 100 and casing 03 120 and with coil windings 102, 103 which are wrapped about the core 101 in a direction normal to the direction of the laminations made from the magnetically permeable material of core 101.

The tool 100 is lowered and positioned to desired depth into the circumferential well casing 120. Electric current is applied to the coil windings 102. The instantaneous primary electric current direction is indicated by "$I_p$" numerically illustrated at 110.

In accordance with Ampere's Law, (popularly known as the Right Hand Rule), the instantaneous magnetic flux indicated by the symbol "B" and numbered 111 is thereby generated about the coil windings 102, 103 in a circumferential path about the conductors.

Since the casing 120 is a closed loop electrical conductor, the magnetic flux 111 induces a secondary electric current, as indicated by the symbol "$I_s$" and numbered 112 to flow in accordance with classic electromagnetic theory based on Faraday's Law. The secondary current $I_s$ 112 is proportional to and in opposite direction to the instantaneous primary current $I_p$. The heat generated in the casing is proportional to the induced power dissipated based on Ohm's Law which relates the current and resistance of the electrical path according to the formula:

$$P=I^2R \tag{1}$$

where P represents the power dissipated, I represents the electrical current, and R represents the resistance of the electrical path. The heat induced in the casing is intended to be used for various purposes, the most germane of which is for melting a material that can be used to seal the annulus of a well casing, or to provide a secondary seal for repairing leaks in primary seal materials used in oil well installations such as cement 126, which typically surrounds the outside of the casing 120 and which cement is used to prevent gas or oil leakage in the annulus 123 surrounding the well casing 120.

Figure 1B:
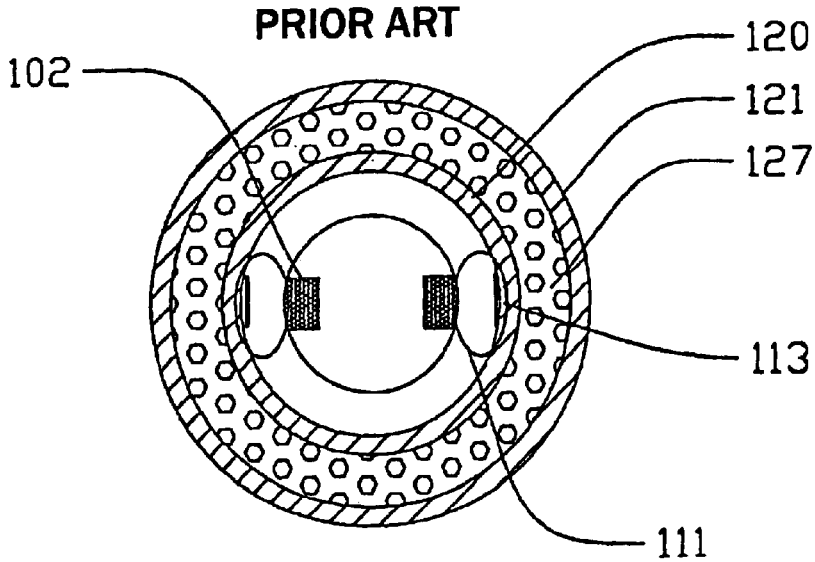
FIG. 1B PRIOR ART
FIG. 1B is a diagrammatic view taken along IA—IA of FIG. 1A.

There are disadvantages with the tool 100 illustrated in FIGS. 1A and 1B. First, since the coil windings 102 and 103 generate a magnetic flux field about the coil, the electromagnetic field strength varies inversely with the distance of the winding from the point of flux measurement. Accordingly, more flux will be generated nearer the windings than at a point further away from them. This results in more heat being generated in the well casing 120 nearer the windings 102 as particularly shown in FIG. 1B and results in discontinuous zones in heat flow or "hot spots" 113 around the well casing 120. The effect of these hot spots 113 are discontinuities in the melting of the eutectic material 127. The seal created from this non-uniform melting exhibits a non-uniform composition which adversely affects seal integrity.

A second disadvantage results from normally occurring discontinuities in the pipe used in the well casing 120. Casing coupling joints 128, for example, have a higher electrical resistivity than at areas of the casing 120 where no joints appear. Likewise, the composition of the casing 120 itself may not be uniform again resulting in differences in resistance to longitudinal current flow in the pipe. These resistance anomalies affect efficient current flow and adversely affect the even and constant induction heating of the casing 120.

Yet a further disadvantage of the PRIOR ART tool 100 is that space for the heating tool 100 is limited by the internal diameter of the well casing 120. If it is intended to increase the power of the tool by increasing the number and quantity of windings 102, increasing the diameter is precluded because of the restricted tool space available within the well casing 103.

Yet a further disadvantage of the PRIOR ART tool 100 is due to the manufacturing costs to produce the stacked lamination core. In practice, various diameters of tools are required to efficiently heat casings in wells with different diameters, thus requiring special tooling to produce various lamination components in addition to the labor intensive assembly required.

Finally, the tool illustrated and described in the '389 patent earlier referred to is itself housed within a stainless steel housing (not illustrated). The steel housing itself is subject to inductive heating by the flux generated. This results in significant inefficiencies since the heat generated in the housing imposes internal heat upon the tool components limiting its operational performance range and reliability. Additionally, some of the flux that is intended to flow through the casing is shunted thereby wasting energy that could otherwise be used to heat the well casing 103.

Figure 2:
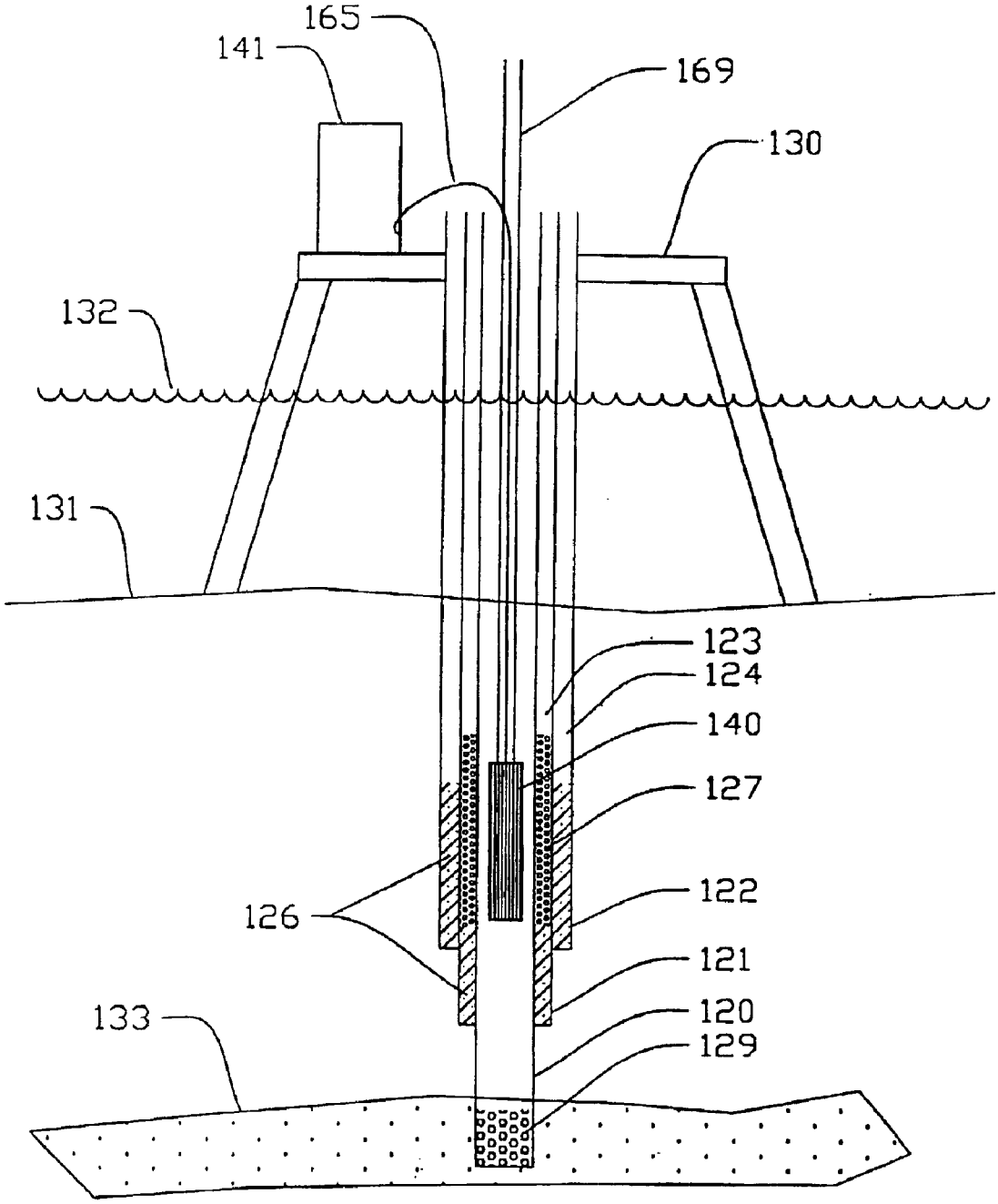
FIG. 2 is a partial diagrammatic side view of an offshore oil or gas well and further illustrating a single inductive heating tool in position within the well casing according to the invention.

Reference is now made to FIG. 2 where the tool 140 according to the present invention is illustrated as being located within the well casing 120 at some distance below the sea floor 132 in a typical offshore application. The well platform is supported above sea level 132 resting on the ocean floor 131. A power control unit (PCU) mounted on the well platform 141 is supplied to apply and control electric power to the tool 140. A plurality of casings are used in this example, namely the tertiary or largest casing 122, a secondary casing 121 and the production casing 120 which extends to the reservoir or oil or gas producing area of interest 133. Perforations 129 are provided in the lower end of the well casing 120 to allow the entrance of oil and/or gas which then is conveyed to the surface as is known.

As each casing ends and the successive interior casing commences, cement is used to seal the respective annuluses outside the respective casings. For example, cement 126 is used to fill the annulus 124 between the secondary casing 121 and the tertiary casing 122 and further cement 126 is used to fill the annulus 123 between the secondary casing 121 and the production casing 120.

Figure 3A:
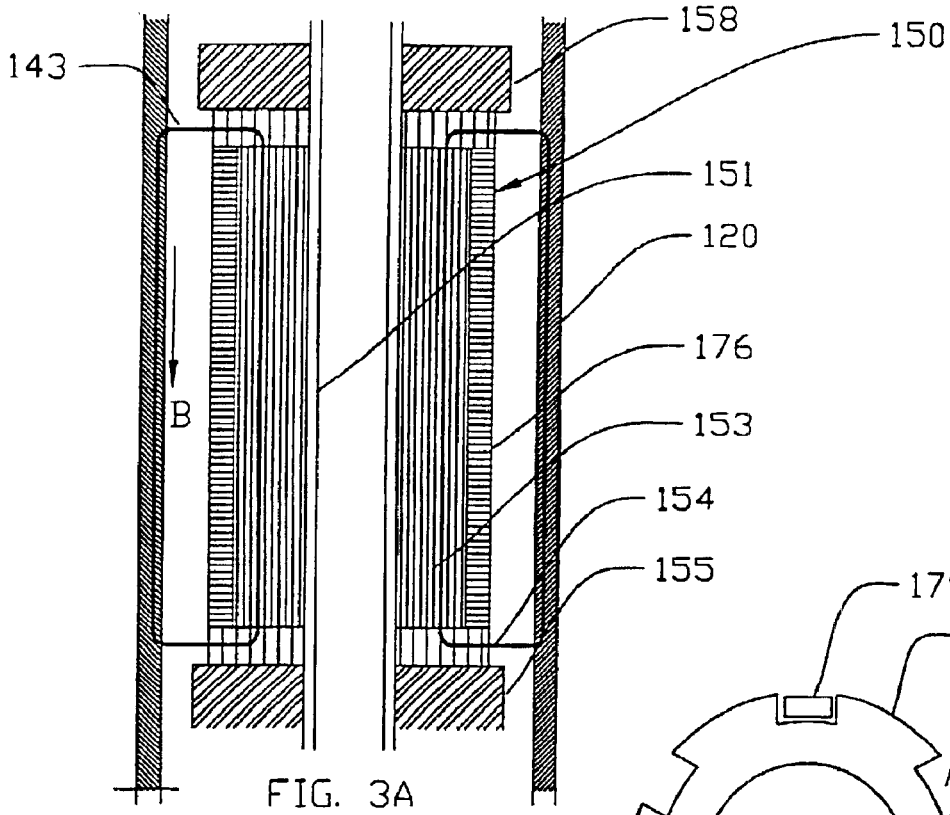
FIGS. 3A and 3B are diagrammatic side and plan views, respectively, of the inductive heating tool according to the invention.
Figure 3C:
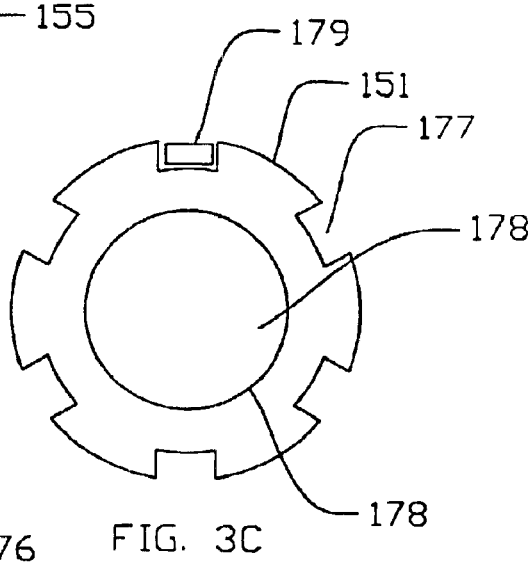
FIG. 3C is a diagrammatic plan view of the core pipe used for supporting the magnetically permeable core material according to the invention particularly illustrating the recess channels in the core pipe providing passageways for the electrical power busses, sensor and data acquisition cables.
Figure 3B:
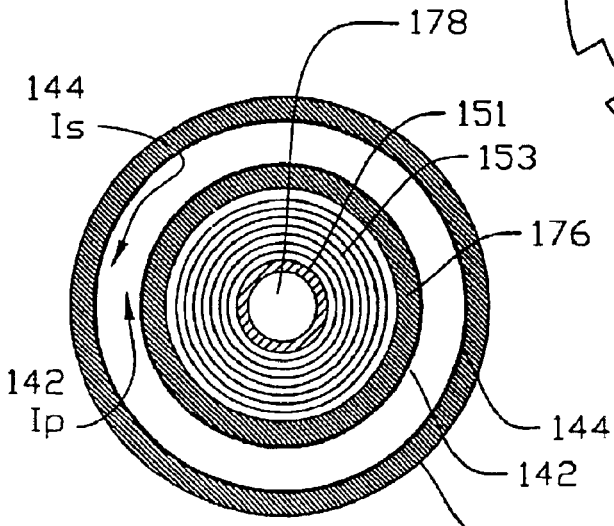

The induction heating tool 140 according to the present invention is illustrated in greater detail in FIGS. 3A, 3B and 3C. A core pipe 151 preferentially made from non-magnetic stainless steel is used as the core for the reactor module 150 and supports the tape wound core 153 as well as defining a bore 178 extending the length of the reactor module 150. Silicon steel, commonly known as transformer steel, conveniently having a thickness of 0.014 inch, is wound about the core pipe 151 in a continuous sheet so that a tape wound core 153 is formed from the silicon steel which core 153 has a high magnetic permeability along its longitudinal axis. An induction coil 176 surrounds the tape wound core 153 and is conveniently made from an insulated flat conductor material which is spirally or solenoid wound from the top of the tape wound core 153 continuously about the entire circumference of the tape wound core 153 a predetermined length of the tape wound core 153. The outside diameter of the tool 150 is defined by the outside of the spiral wound coil 176. Core end plates 154 are also fitted at each end of the tape wound core 153, each having an outside diameter designed to minimize the magnetic air gap between the outside diameter of the reactor module 115 and the inside diameter of the casing 120.

The core pipe 151 about which the sheet silicon steel is wound may conveniently take a configuration as illustrated in FIG. 3C, with recess channels 177 illustrated in addition to the bore 178 to provide passageways for insulated electrical power buss conductors 179 sensor and data acquisition cables can be routed through the length of the reactor module 150 of the assembled tool 140. The recesses 134 provide an advantageous design feature in order minimize the distance between the induction coil 176 and the casing 120. They serve as channels for the flow of pressure compensating high dielectric fluid 161 within and between reactor modules 150 and they provide a degree of electromagnetic shielding for the sensor and data acquisition cables routed through them.

Figure 4:
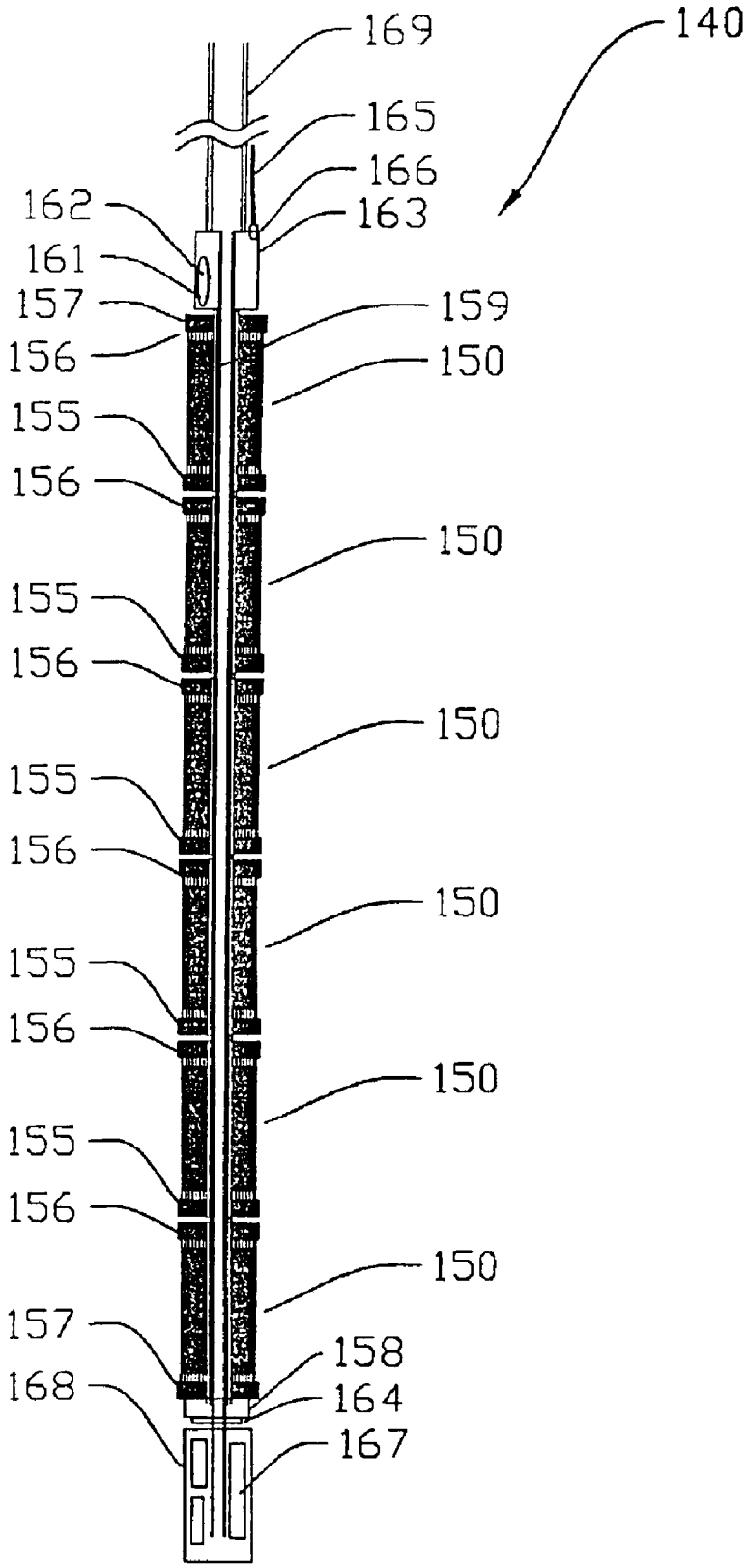
FIG. 4 is a diagrammatic side view of a plurality of inductive reactor modules assembled as a tool and used for well casing heating according to the invention.

With reference now to FIG. 4, a downhole electromagnetic induction heating tool 140 is configured and assembled by a series of identical reactor modules 150, each reactor module being similar to the reactor module 150 as illustrated in FIGS. 3A–3C. The reactor modules 150 are connected, one to another by means of male and female mating connection couplings 155, 156, respectively. These connections 155, 156 are part of each reactor module 150.

A central support tube 159, preferentially made from stainless steel, extends through the bore 178 of each reactor module core pipe 151, the length of which is determined by the number of reactor modules 150 assembled together to form the tool 140. The uppermost reactor module coupling 150 preferentially mates with and attaches to a male tool end coupling 157 and a support tube adapter 163 for connection of the tool 140 to downhole production tubing 169 or to a cable (not shown) conveniently used for the purpose of positioning the tool to a position within the well as may be desired.

The male reactor module coupling 157 on the lowermost reactor module mates with and attaches to a female tool end coupling 158. The bottom is preferentially secured to the central support tube 159 by means of a tool bottom clamp nut 164. The reactor modules 140 may be electrically connected for use with either a poly-phase or single phase power supply. The connection of a downhole electric power cable 165 to the heating tool is made by means of an downhole electrical power connector 166 installed to the male tool end coupling 157.

A downhole data acquisition and telemetry electronics unit (DTU) 167 is contained within a pressure vessel 168 located beneath the tool bottom clamp nut 164 to provide measured temperature, voltage, current and flux data from the tool 140 to the PCU for process control and analysis purposes.

The power control unit or PCU 141 (PCU) (FIG. 5) is located on the well platform 130 (FIG. 2) and the three phase electrical cable 165 extends to the tool 140 within the production casing 120. The power control unit 151 provides and regulates the electric power applied to the tool string 140 as required to achieve and maintain the temperature of the casing 120 required to melt the eutectic alloy material 127. The PCU also integrates with various electrical monitoring devices so that the position of the tool 140 within the well casing 120 and the power provided to the tool 120 may be determined. Sensing devices can be used to monitor and predict the necessary power to be applied to the tool depending on the size and position of the secondary or tertiary casings within which the tool 120 140 is intended to be positioned during operation may also be provided within the power control unit 141.

Operation

In operation, the appropriate number of reactor modules 150 are mechanically assembled and electrically connected by means of reactor module mating male and female support couplings 155, 156, respectively, as is shown in FIG. 4. The assembled tool string 140 can be suspended by a downhole support pipe such as oil well production tubing 169 or by a cable (not shown) within the production casing 120 (FIG. 2) and lowered to its desired position where heating is intended to occur. The desired position may be ascertained by means of various types of sensors typically used in oil wells to locate subterranean features. It will be noticed that the central support tube bore 181 that extends throughout the length of the tool 140 allows water and other well fluids to pass through the tool 140 thereby eliminating developing pressure while the tool is inserted or extracted due to the restricted gap between the tool 140 and the production casing 120.

Figure 5:
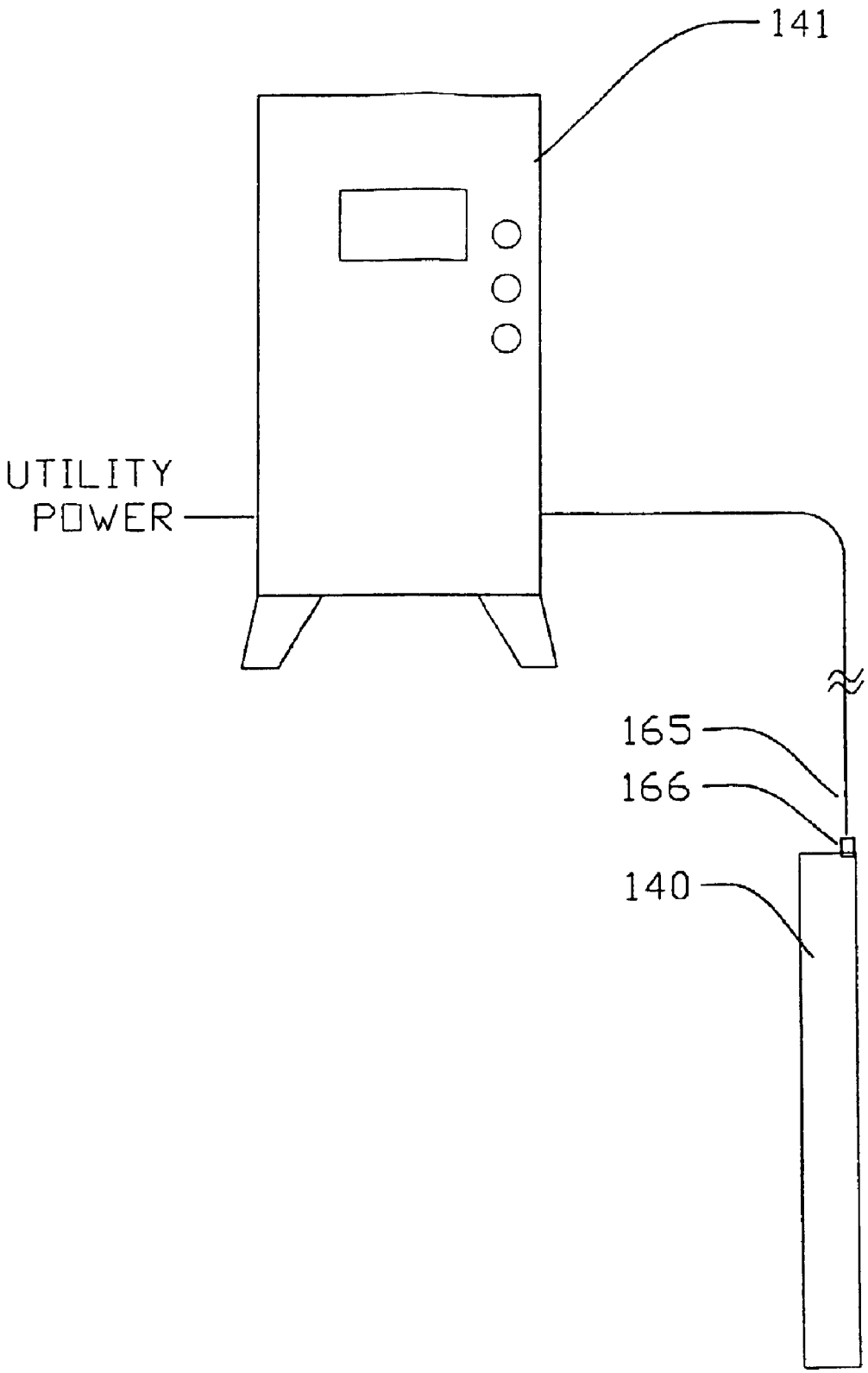
FIG. 5 is a diagrammatic side view of the inductive heating tool according to the invention with a power control unit (PCU) located on the surface which PCU is used for applying and controlling power applied to the inductive heating tool.

When the tool string 144 is properly positioned within production casing 120, power will be applied to the induction coils 176 from the power control unit 141 through the power cables 165 (FIG. 5). The power applied to the tool string induction coils 176 is regulated based on reactor module temperature reported by the DTU 167.

The induction tool 140 is intended to raise the temperature of the production casing 120 to a degree that heat radiating outward from said casing will cause the eutectic material 127 located within the annulus spaces to uniformly melt and form a seal when the material again solidifies. Likewise, if the use of the tool 140 is intended to reduce the viscosity of the fluid or gas flowing from the formation and thereby enhance recovery, the power will be applied as has been previously determined to have the most efficacy for the enhanced recovery of oil and/or gas.

The manufacture of the tape wound core 153 illustrated in FIGS. 3A and 3B is of interest. Whereas previous cores have been made by individual sheets of magnetically permeable material laminated together to form the core, it is contemplated that a single sheet of 0.14 inch non-oriented high permeability silicon steel material could conveniently be used. One end of the steel material is conveniently connected to the core pipe 151 by spot welding or the like and the material is simply wound onto the core pipe 151 by rotating the core pipe 151 and maintaining the sheet steel material under appropriate tension during the core pipe rotating process until the desired diameter of the core 153 is reached, which process would desirably give a 95–98% steel fill value for the core 153. Although the silicon sheet material is conveniently non-oriented, grain oriented steel would be magnetically advantageous and useful if available with an orientation normal to the direction of the roll.

With the grains oriented normal to the core pipe 151 in the sheet material, the core would have a higher permeability in it's longitudinal direction thereby enhancing the flux flow through the material in the preferential axial direction.

The spiral wound coil 176 is preferably made from a flat electrical conductor with a high temperature type resin coating spirally or solenoid wound about the tape wound core 132. The use of the flat electrical conductor as coil material reduces the interstitial gaps otherwise present with the usual round electrical conducting wire material typically used and thereby provides a higher magnetic flux density emanating from the core material because of the greater number of conductor turns within a unit coil size.

The two core end plates 154 for reactor module 150 are conveniently also made from the sheet silicon steel material used for the tape wound core 153. This material is wound with an inside bore dimensioned to assemble to the core pipe 151, it being noted that the outside diameter of the end plates 154 is preferably at least the same dimension as the outside diameter of the spiral wound coil 176. The end plates 154 provide a high permeability path for the flux emanating from the core 153 and help to direct flux toward the well casing 120. By providing a low reluctance, high permeability path, as well as reducing the air gap between the ends of the core 153 and the casing 120, the density of the flux passing to the production casing 121 is increased thereby enhancing induction heating of the casing 120.

Figure 6A:
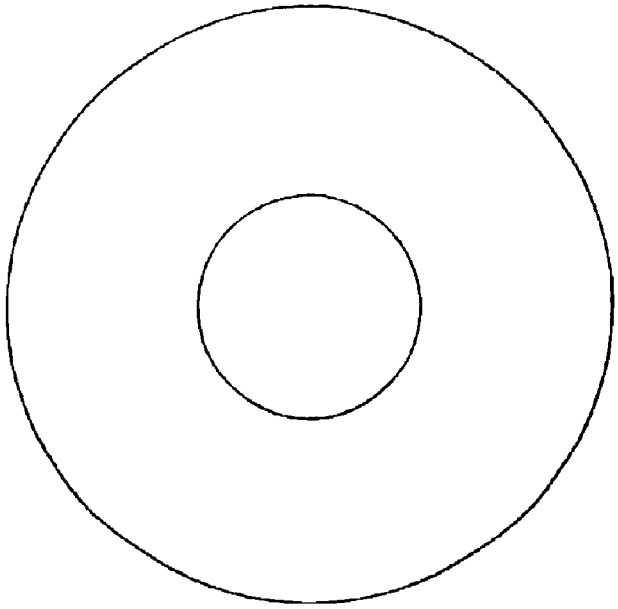
FIGS. 6A through 6E are diagrammatic side views of different end core configurations for the heating tool of FIG. 3A which may be used to enhance flux transfer from the inductive heating tool to the well casing according to the invention.
Figure 6B:
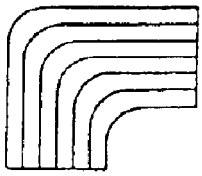
Figure 6C:
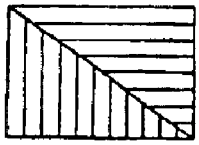
Figure 6D:
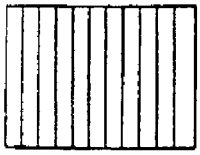
Figure 6E:
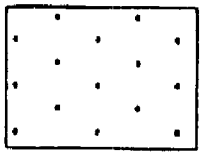

In a similar manner, core end plates 154 could take alternative configurations as illustrated in either of FIGS. 6B, 6C or 6D. FIG. 6A is a plan view that indicates the circular shape with an bore to allow it to be assembled over the core pipe 151. FIG. 6B represents a profile view of a core end plate manufactured by form stacking sheets of high permeability non-oriented silicon steel. FIG. 6C represents a profile view of a core end plate manufactured by miter joining a tape wound core and a stacked lamination core components both made from high permeability non-oriented silicon steel. FIG. 6D represents a profile view of the tape wound core end plate heretofore described made from high permeability non-oriented silicon steel. FIG. 6E represents a profile view of a core end plate manufactured from a high permeability sintered metal process.

Each of the FIGS. 6B–6E configurations reduce the magnetic reluctance path and thereby promotes flux emanating from the core 153 to the casing 120. In a further embodiment of the invention, reference is made to FIGS. 3A, 7A and 7B, where temperature measurement of the induction coil 176 and core 153 (FIG. 2) may be obtained.

Figure 7A:
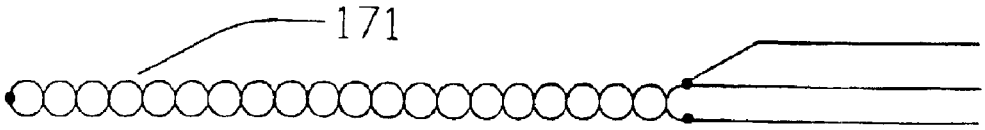
FIG. 7A is a diagrammatic side view illustrating a twisted bifilar cable used to sense the temperature of the reactor module according to the invention.
Figure 7B:
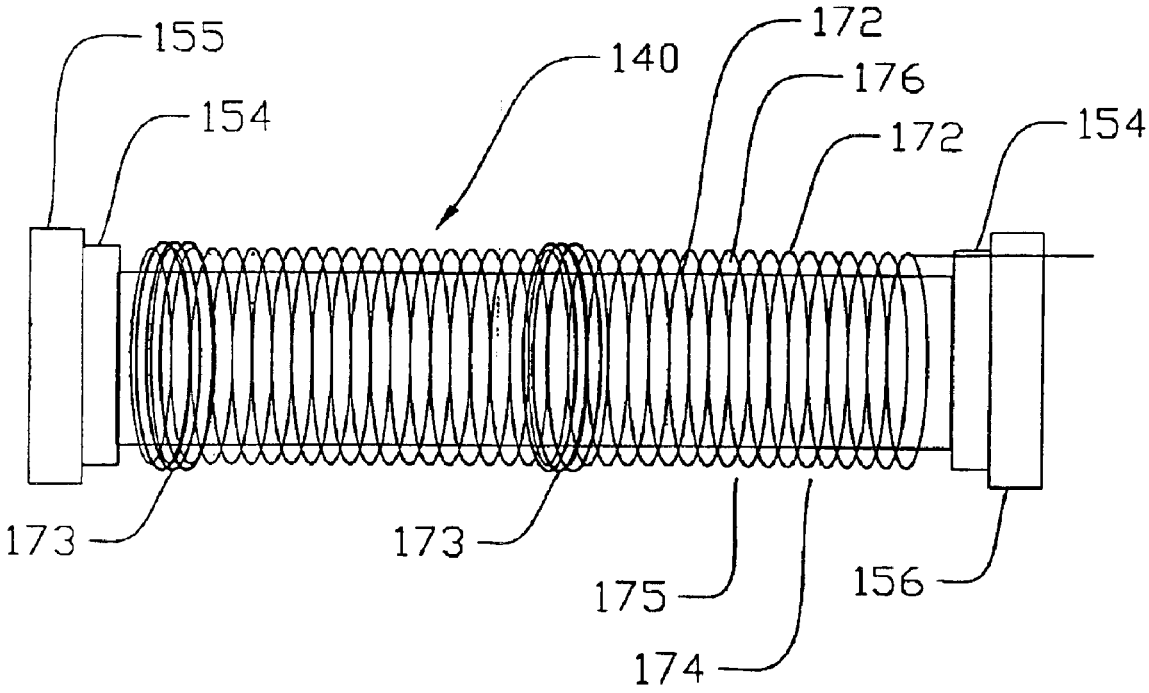
FIG. 7B is a diagrammatic side view illustrating sensor coils wound about the circumference of a reactor module and being used for sensing the temperature of the core and inductor coil, the flux intensity at the middle and one end of the reactor, the inductor coil voltage and the inductor coil current.

Twisted bifilar wire cables 171 (FIG. 7A) having two twisted conductors in order to cancel out the generation of any induced current in the wire 171 are spirally wound around the diameter of the tape wound core 153 and likewise the induction coil 176. The resistance of the bifilar twisted wire cables 171 are measured during operation to provide the temperatures of the tape wound core 153 and of the induction coil 176. As is indicated in FIG. 7A, the wires are connected to the instrumentation electronics using a Kelvin connected cable in order to reduce measurement errors otherwise introduced by the length of the connecting cable. Since the resistance of the bifilar wire 171 increases proportionately with temperature, the temperatures of the coil 176 and of the reactor tape wound core 153 are obtained. Such temperature measurements are useful since the power being applied to the tool 140 can be accordingly controlled in order to achieve a predetermined temperature set point and to prevent overheating of the tool 150 components. Further, temperature data on the coil 176 and the tape wound core 153 is useful to compile a database of various operating conditions which can be used for further and different applications of the same nature.

Figure 8:
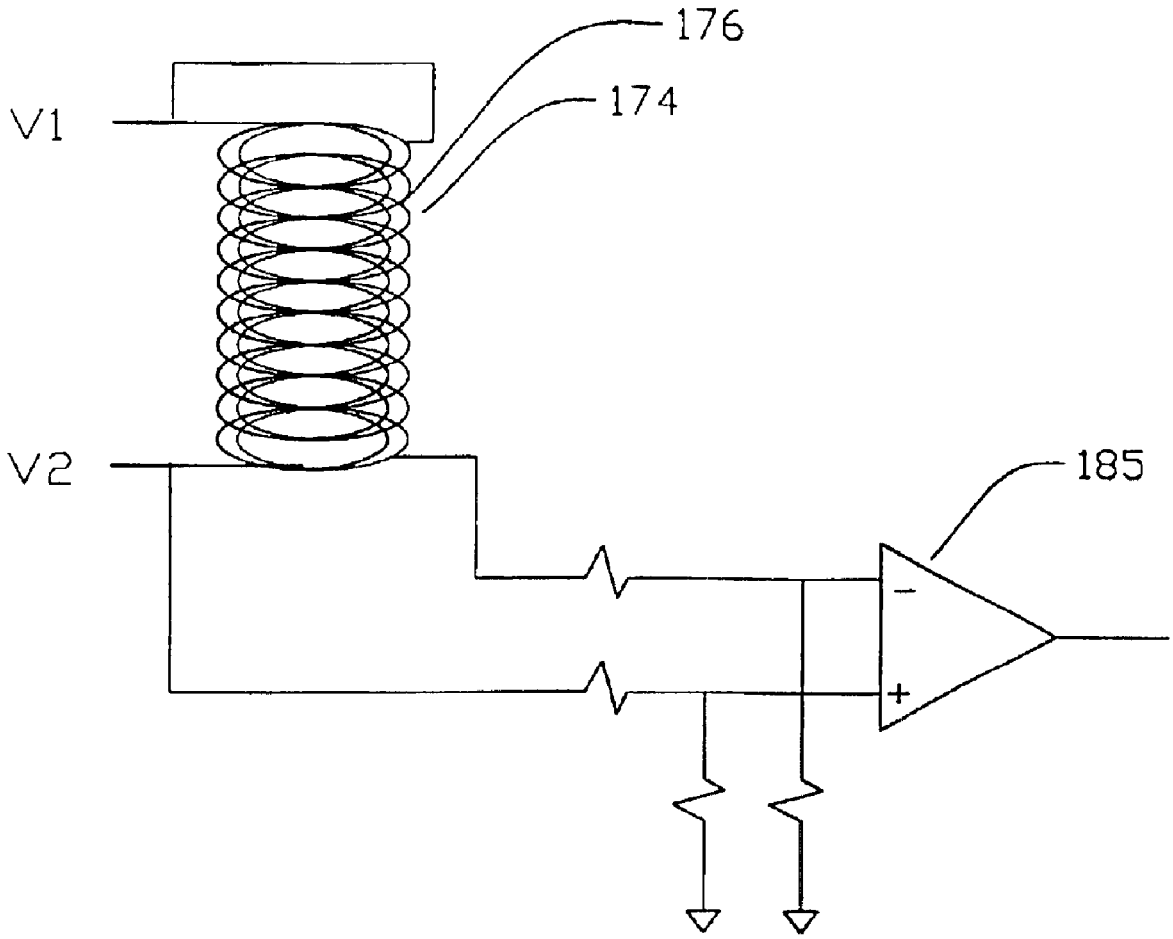
FIG. 8 is a diagrammatic schematic view of the reactor module induction coil with an additional current sensing coil and differential amplifier circuit used to determine inductor coil phase shift and casing temperature.

In a further embodiment of the invention, it may be desirable to indirectly determine the temperature of the casing 120 which is subject to the inductive heating created by tool 140. This process proceeds by determining the change in permeability of the casing 120 relative to the change in temperature that has been calibrated with a database correlating material permeability with respect to temperature. In this process and with reference to FIGS. 7B and 8, data from sense coils wound circumferentially about the reactor module 150 are utilized to determine power line phase shift relative to permeability.

The coils include the bifilar twisted temperature sense coils 172 wound about and to measure the temperatures of the tape wound core 153 and the induction coil 176, the two flux sense coils 173 wound at the middle and at the end positions of the induction coil 176, the current sense coil 174 wound about and connected at one end to the inductor coil 176 and the voltage sense coil 175 wound about the length of the inductor coil 176. The induced voltage waveforms in the above indicated sense coils are therefore measured and transmitted by the DTU 167 and signal processed by the PCU 151 controller to determine the phase shift of the power applied to the inductor coil 176 and induced to the casing 120. Since this sensed current represents the induced coil current, the current in casing 120 can accordingly be inferred. The phase shaft is proportional to the increased temperature in the casing 120. Look up tables and/or other calibration data may be used to determine a value for the temperature of the actual casing 120.

In yet a further embodiment of the invention, it may be desirable to heat a secondary casing 121 by means of first magnetically saturating the production casing 120. This may be beneficial, for example, where gas or oil leakage through cement is discovered in a secondary 124 or tertiary annulus 125 separated but concentric to the production casing 120. In this technique, the permeability of the casing material is known to be significantly less than the tape wound cores 153 of the tool 150. The core 153 is operated at a temperature considerably less than the temperature induced ed in the casing 120. The permeability of the low carbon steel casing 120 decreases with increasing temperature and therefore the casing 120 becomes magnetically saturated at a much lower flux density than does the tape wound core 153. The "excess" flux after the production casing 120 has become saturated must therefore extend preferentially towards and into the next magnetically low reluctance path, since, in a manner analogous to electric current flow, magnetic flux must follow a closed path. If the permeability of the tape core 153 is known as well as the permeability of the production casing 120, power can be applied to the tool 140 to further drive the production casing into saturation and thereby induce current in a secondary casing 121 to generate heat.

Figure 9:
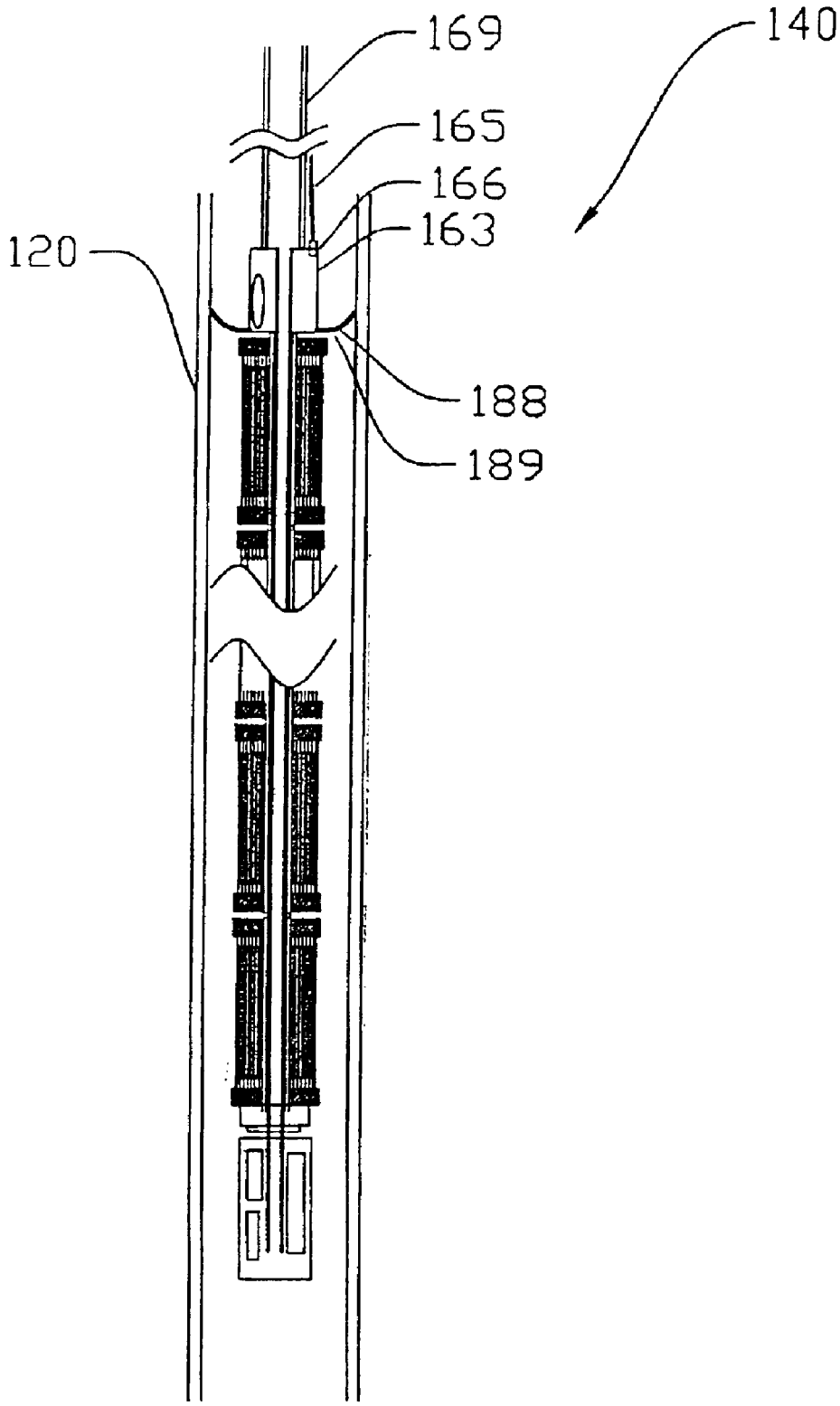
FIG. 9 is a diagrammatic side view of the electromagnetic tool in position within the well casing and utilizing a centralizing stopper with a mounting collar according to a further aspect of the invention.

In a further embodiment of the invention and with reference to FIG. 9, a centralising tool is generally illustrated at 188 which may also include a fluid stopper 189, preferentially mounted at the top of the tool 140. The centralising stopper is mounted about the periphery of the outside diameter of the tool 140. The use of the centralising tool 200 allows the tool 120 to be more properly concentrically positioned within the inside diameter of the casing 120 so that the gap between the tool 120 and the casing 111 is equalized in order to maximize uniformity of flux paths between the tool reactor modules 140 ant the casing 120.

The stopper device 189 further provides a barrier to liquid flow between the tool 150 and the casing 120. The flow of liquid is preferably minimized since fluid due to thermal convection caused by heat induced in the casing 120 contributes to cooling of the casing 120 as cooler water and/or other downhole fluids are convectively drawn upward. The stopper 189 on tool 200 is conveniently mounted to the support tube adapter 163 and the tool 140.

Figure 10:
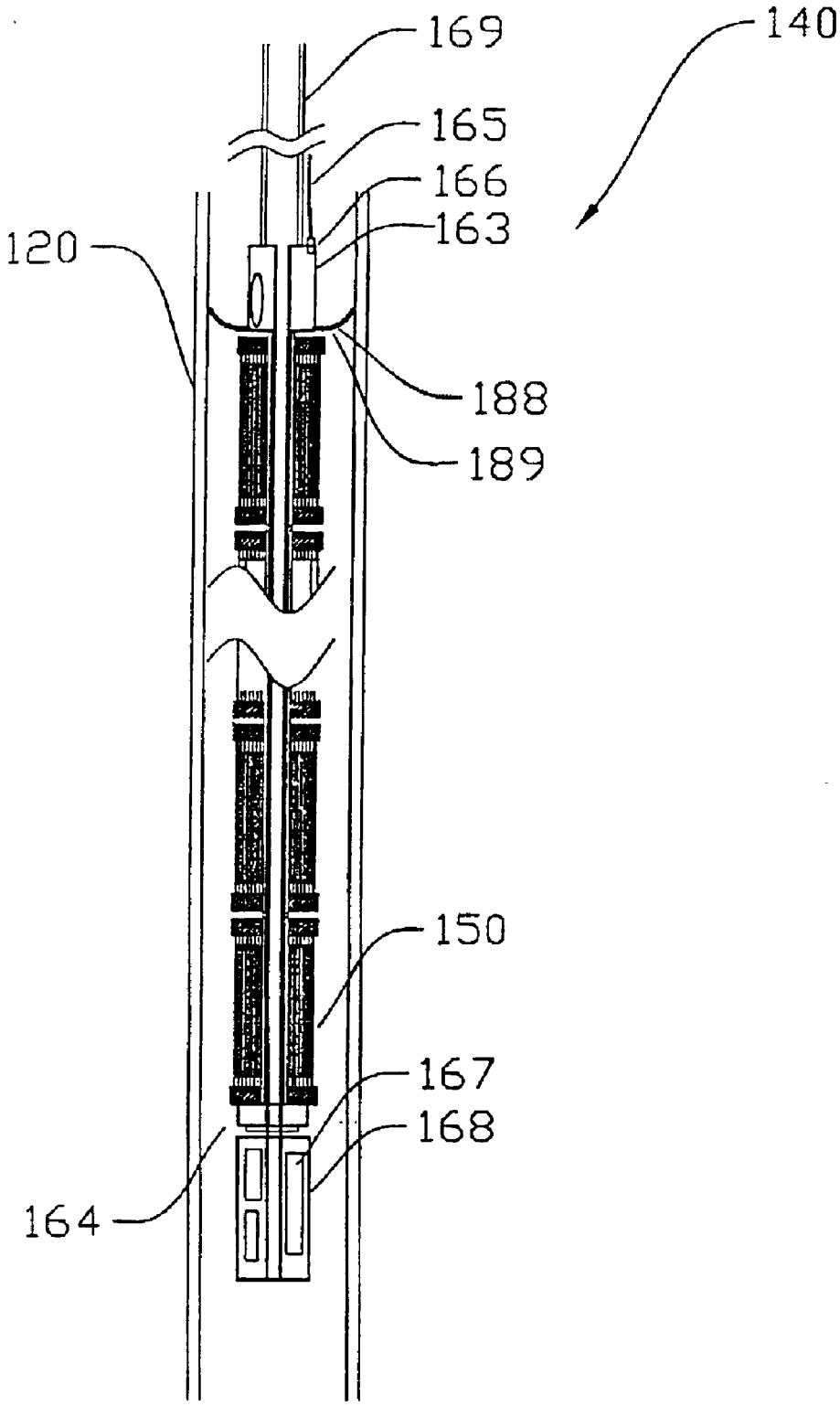
FIG. 10 is a diagrammatic side view of the electromagnetic tool according to the invention and further illustrating a data telemetry unit mounted on the end of the tool according to a further aspect of the invention.

A data telemetry unit ("DTU") generally illustrated at 167 is physically attached at the bottom of the tool 140 as illustrated in FIG. 10. The DTU 167 is enclosed within a pressure vessel 168 and provides multiple channels of analog and digital signal conditioning and processing for transmission to the surface PCU 141 (FIG. 2). Downhole measured data includes tool temperatures, inductor coil voltages, currents and the like as may be required. The DTU 167 further conveniently includes a power supply, a signal conditioning programmable logic device ("PLD"), analog to digital conversion and power line carrier transmitter electronics, all of which may be used, in order to transmit serial data packets to the surface PCU controller 141 via the downhole power cable 165 (FIG. 4).

The operation of the tool 120 conveniently utilizes either a polyphase or single phase utility electric power source at 50/60 Hz. FIG. 11E indicates a preferential single phase reverse alternating series connection scheme. This configuration is advantageous since the higher effective series resistance of the inductor coils 176 allows a higher voltage and correspondingly lower current to be used to achieve a given power level applied. Higher applied voltage minimizes losses due to the long downhole power cable required to position the tool in typical downhole applications thereby providing higher tool efficiency. Each reactor module 150 includes configurable power buss bars 180 to allow appropriate connection of the induction coils 176 of the reactor modules 150 to either single phase or polyphase power sources.

Figure 11A:
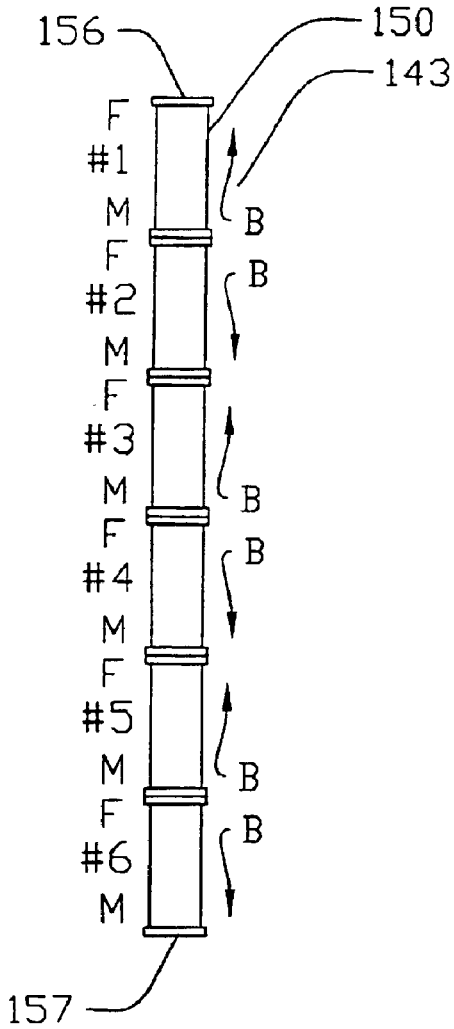
FIG. 11A is a diagrammatic side view of the tool assembly reactor modules indicating a preferential orientation of mating couplings.
Figure 11B:
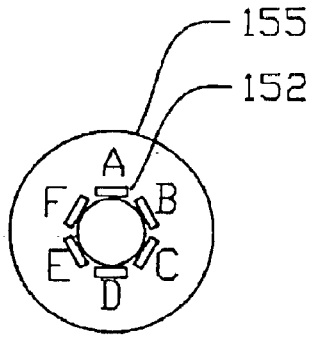
FIGS. 11B and 11C are diagrammatic plan views of mating male and female reactor module end couplings which indicate preferential alignment and designations of core pipe channels used to route power busses through the reactor modules.
Figure 11C:
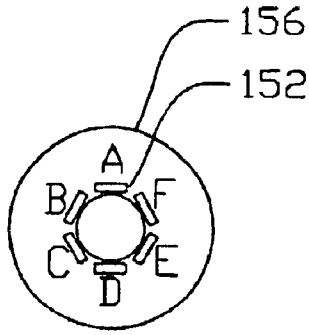
Figure 11D:
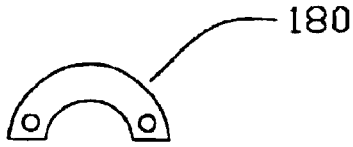
FIG. 11D is a diagrammatic end view illustrating a preferential buss bar link used for linking buss bars within the reactor module end couplings.
Figure 11E:
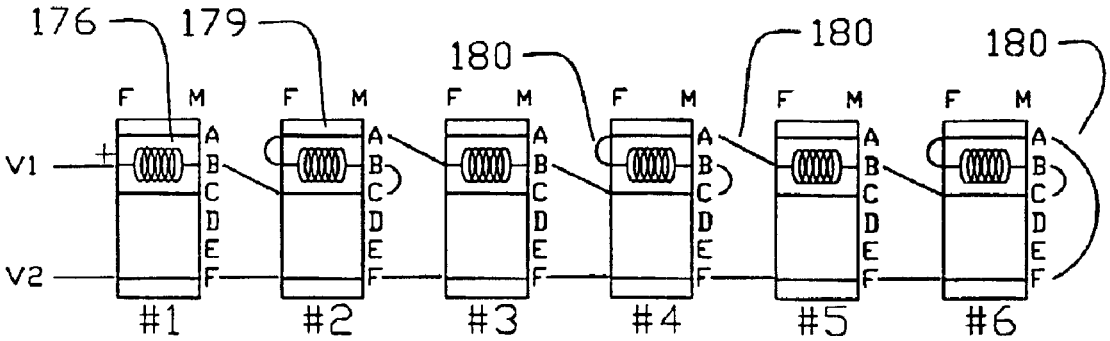
FIG. 11E is a diagrammatic schematic of a heating tool assembly illustrating a single phase alternating reverse wiring configuration used for causing the direction of magnetic flux at each end of adjacent reactor modules to be oppose thereby directing flux more directly toward the casing.

The buss bars 180 would conveniently further allow the coils 176 of the tools 140 to be selectively connected such that the longitudinal aligned magnetic polarity of each reactor module 150 can be configured with respect to adjacent modules as best seen in FIG. 11A which illustrates the opposing instantaneous flux directions "B" 143 generated by each reactor module 150. This allows the preferred configuration using single phase power with each adjacent core end having like opposed magnetic poles. The configuration contributes to the promotion of flux emanating from the end of each core of each tool 150 such that the flux is more efficiently directed toward the well casing 120 (FIG. 9) rather than into reactor module couplings 155 and 156, or into adjacent reactor cores. Minimizing stray flux from passing through the reactor module end couplings 155 and 156 is desirable since the couplings are necessarily made from electrically conductive metal material which would be subject to induced current flow and would generate heat thereby reducing the operating efficiency of the tools 140.

Yet a further aspect of the invention is directed towards the configuration of the individual reactor modules 150 which reactor modules 150 are intended to be interchangeable. Each of the reactor module 150 end couplings 155, 156 and tool end couplings 157, 158 are designed to have a common mounting configuration and dimensional features such as o-ring seals 160 throughout the tool string 140. By providing reactor modules with common mounting configurations, the repair and replacement of individual reactor modules 150 will be facilitated and the production costs per unit will be reduced.

While the principal focus of the present invention has been on the use of the tool 140 as an inductive heating tool to melt an alloy and thereby form a seal in the annulus of a well casing over a leaking cement seal, it is contemplated that the heating provided by the tool may well be useful for other purposes in the oil and gas industry and, more particularly, in the heating of well casing to promote enhanced recovery of oil and gas from a formation where it is desirable to heat the formation to assist fluid flow through reduced viscosity. Indeed, many other applications for the inductive tool even outside the oil and gas industry might usefully be achieved through the use of flux generated by the efficiencies of the tool according to the present invention.

A eutectic metal mixture, such as tin-lead solder is conveniently used because the melting and freezing points of the mixture is lower than that of either pure metal in the mixture and, therefore, melting and subsequent solidification of the mixture may be obtained as desired with the operation of the induction apparatus 111 being initiated and terminated appropriately. This mixture also bonds well with the metal of the production and surface casings 102, 101. The addition of bismuth to the mixture can improve the bonding action. Other additions may have the same effect. Other metals or mixtures may well be used for different applications depending upon the specific use desired. For example, it is contemplated that a material other than a metal and other than a eutectic metal may well be suitable for performing the sealing process.

For example, elemental sulfur and thermosetting plastic resins are contemplated to also be useful in the same process. In the case of both sulfur and resins, pellets could conveniently be injected into the annulus and appropriately positioned at the area of interest. Thereafter, the solid material would be liquefied by heating. The heating would then be terminated to allow the liquefied material to solidify and thereby form the requisite seal in the annulus between the surface and production casing. In the case of sulfur pellets, the melting of the injected pellets would occur at approximately 248 deg. F. Thereafter, the melted sulfur would solidify by terminating the application of heat and allowing the subsequently solidified sulfur to form the seal. Examples of typical thermosetting plastic resins which could conveniently be used would be phenol-formaldehyde, urea-formaldehyde, melamine-formaldehyde resins and the like.

Figure 12:
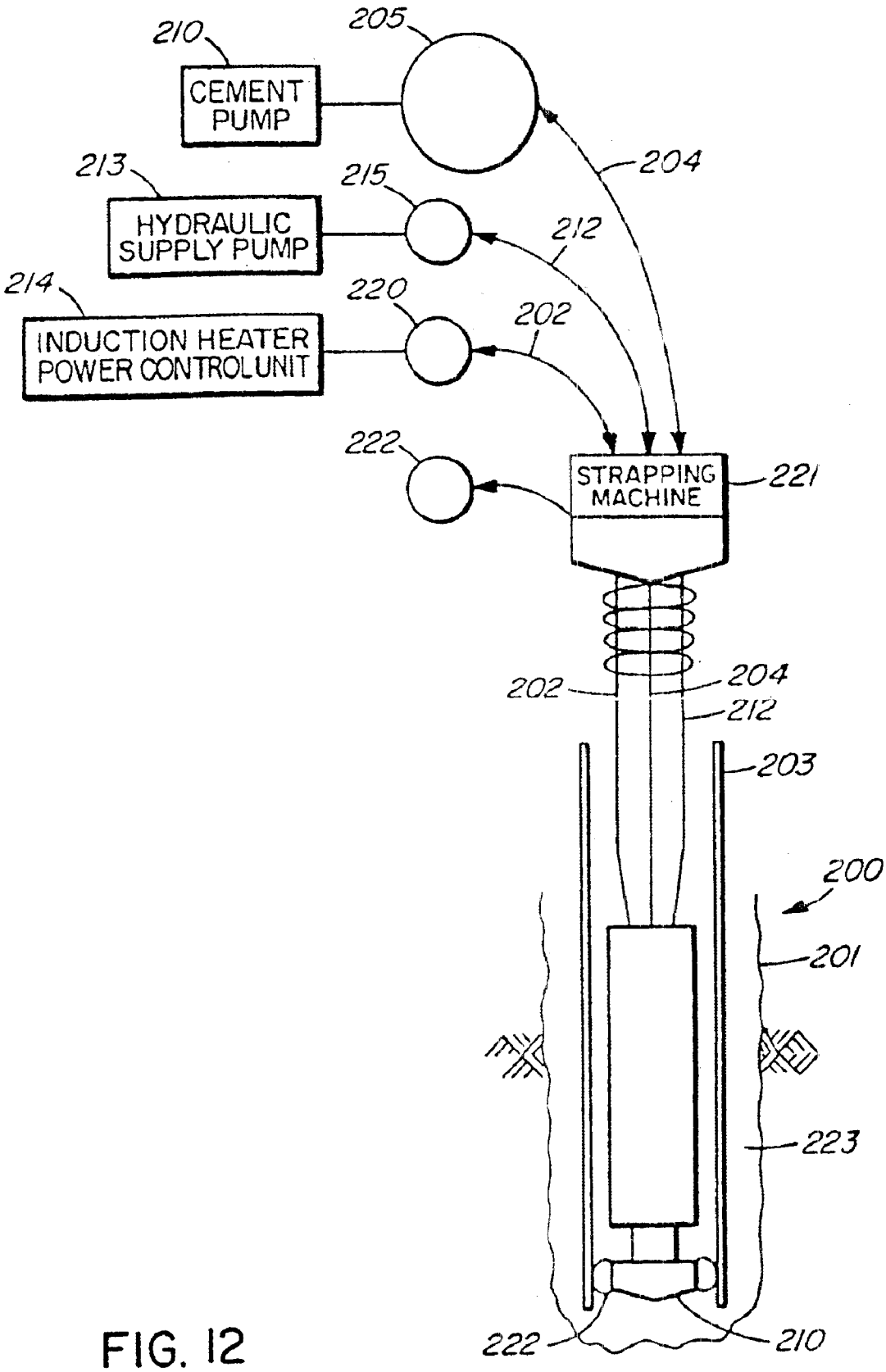
FIG. 12 is a diagrammatic side cross-sectional view of an inductive heating tool according to the invention lowered to an operating position within the wellbore and used for curing casing cement according to a further aspect of the invention.

A further aspect of the invention is illustrated in FIG. 12 in which an inductive type well heating tool according to the invention is shown generally at 200. Tool 200 is illustrated in its operating position within the wellbore 201 of an oil or gas well which has been drilled using conventional technology as is known. The tool 200 is connected to a power and lifting cable 202 used to raise and lower the tool 200 within the wellbore casing 203 and to supply the necessary power to the heating tool 200. The power and lifting cable 202 is extended and retracted from a power cable supply reel 220. It is desired in this embodiment to supply cement surrounding the casing 203 and within the wellbore 201 for well sealing purposes.

A cement feed tube 204 extends from the surface of the well from a cement pump 210 to the induction heating tool 200. The cement feed tube 204 extends from a surface located feed tube reel 205 and is fed from that reel. The cement feed tube 204 extends through the central portion of the tool 200 and delivers cement to the bottom of the casing 203 and utilises a downhole cement dispensing head 210 in combination with a hydraulically activated bladder 222 as will be described.

A further hydraulic oil feed tube 212 is connected to a surface located hydraulic supply pump 213 and a supply reel 215 provides for the length of tube 212 needed to extend to the downhole induction heating tool 200. The supply pump 213 provides the hydraulic oil to the feed tube 212 and such oil is delivered to the cement dispensing head and bladder 210. An induction heater tool control unit 214 provides the necessary power to the downhole induction heating tool 200 and it further controls and monitors the power supplied to the tool 200. Further, the unit may include monitoring apparatuses for monitoring the temperature over time of the casing 203 in the vicinity of the tool 200, the temperature operating on the cement during its set.

A strapping machine 221 is supplied by strapping material from a strapping material supply source 222. The strapping material provides strapping around the power cable 202, the cement feed tube 204 and the hydraulic oil feed tube 212 which are thereby aligned, gathered tightly together and spirally wrapped. The wrapped components extend through the central bore of the well heating tool 200. Such wrapping supports the cables and prevents twisting of the cables during deployment of the tool 200.

In operation, the tool 200 will be lowered to its desired position within the wellbore casing 203 where it is desired to be deployed and to cure the cement installed between the casing 203 and the wellbore 201. The hydraulic tubing 212, the power cable 202 and the cement feed 204 all are deployed from the respective supply reels, 215, 220, 205, respectively, as the tool 220 is lowered.

When the desired position is reached and the cement dispensing head 210 is in its operating position, hydraulic pressure is supplied by the supply pump 213 through the hydraulic feed tube 212 to bladder 222 which is associated with the cement dispensing head 210. The bladder 222 expands under the pressure of the hydraulic fluid and forms a seal within the casing 203 which seals the casing 203 below the tool 200.

Cement is then pumped by the cement pump 210 through the cement feed tube 204. The pumped cement exits the cement dispensing head 210 and is forced downwardly to the lower end of the casing 203 and then upwardly within the annular space 223 between the wellbore 201 and the casing 203 until the desired quantity of cement is in place in the annulus.

Power is then supplied to the induction heater 200 by the power supply cable 202 from the power control unit 214. The power supplied will create an induction flux in the casing 203 adjacent the tool 200 until the casing 203 reaches a desired temperature which is supplied to the cement adjacent the casing 203 for a certain time period so as to activate the cement within the annulus 223 and therefore to set the cement.

After the desired temperature has been reached and the desired time for setting the cement has passed, the power supplied to the tool 200 is terminated and the hydraulic pressure within the bladder 222 is released thereby to allow the bladder 222 to reduce its size within the casing 203. The tool 200 may then be raised by reeling in the cement feed tube reel 205 together with the supply reels 215, 220 for the hydraulic tubing 212 and the power cable 202, respectively. As the tool 200 is raised, the strapping machine 221 will unwind the strapping bands from the tubing extending to the tool 200.

In a further embodiment of the invention, the hydraulically operated bladder 222 is replaced with a check valve type bladder which is activated by a thermal expanding cement. When the cement is pumped downhole to the cement dispensing head 210, a certain portion would also be supplied to the bladder 222 through the check valve which cement would expand the bladder upon heat being supplied by the tool 200 to thereby seal the casing 203 and form a permanent plug within the casing 203. The cement dispensing head 210 will be disassociated with the plug after the plug has been activated which would allow the tool 200 and the cement dispensing head 210 to be removed from the well following the setting of the plug and the setting of the cement in the annulus 223 by the heating tool 200.

In experiments recently conducted, it has been further discovered that electromagnetic induction from the electromagnetic induction tool may also be introduced directly into an electrically conducting material intended to be melted when the material is adjacent the electromagnetic induction tool. It is contemplated that the induction excites the molecules within the metallic material thereby raising the temperature and melting the material directly without necessarily using the heated well casing to transfer heat to and otherwise melt the electrically conducting material outside the casing. This technique may well be useful in the event that the well casing is made from steel or non-metal well casings are used in the oil or gas well and it is desired to melt the electrically conducting material surrounding the casing.

More specifically, it was found that when a bismuth alloy wire known as a Wood's Metal alloy was formed in a loop and positioned such that the loop surrounded the induction tool, the tool could create excitation within the wire to such an extent that it melted. It is believed that such a technique could only occur if the material surrounded the circumference of the tool such that there is a closed electrical path surrounding the tool.

In addition to the bismuth wire, it may be convenient to place pellets and an electrolyte solution in the annulus surrounding the well casing. The induction tool would be similarly surrounded by the well casing and the necessary induction would be directly induced in the pellets thereby raising their temperature and causing them to melt to assist in completing and sealing the well as previously described.

Many modifications in addition to those specific embodiments disclosed will readily occur to those skilled in the art to which the invention relates. The present embodiments, therefore, should be taken as illustrative of the invention only and not as limiting its scope as defined in accordance with the accompanying claims.

I claim:

1. Method of melting electrically conductive material surrounding the casing of an oil or gas well with an electromagnetic induction tool comprising providing said electrically conductive material around the circumference of said tool and inducing electromagnetic induction from said tool into said material, raising the temperature of said material to a value sufficient to melt said material.

2. Apparatus for melting electrically conductive material in the annulus of an oil or gas well comprising an electromagnetic induction tool, a power supply to supply power to said tool and material operable to surround the circumference of said tool, said material being an electrically conductive material forming a closed loop surrounding said circumference.

* * * * *